US010060656B2

(12) United States Patent
Tsuchiya et al.

(10) Patent No.: US 10,060,656 B2
(45) Date of Patent: Aug. 28, 2018

(54) PULSE TUBE REFRIGERATOR

(71) Applicant: SUMITOMO HEAVY INDUSTRIES, LTD., Tokyo (JP)

(72) Inventors: Akihiro Tsuchiya, Nishitokyo (JP); Mingyao Xu, Nishitokyo (JP)

(73) Assignee: SUMITOMO HEAVY INDUSTRIES, LTD., Tokyo (JP)

( * ) Notice: Subject to any disclaimer, the term of this patent is extended or adjusted under 35 U.S.C. 154(b) by 87 days.

(21) Appl. No.: 14/840,353

(22) Filed: Aug. 31, 2015

(65) Prior Publication Data

US 2016/0069593 A1 Mar. 10, 2016

(30) Foreign Application Priority Data

Sep. 10, 2014 (JP) ..... 2014-184281

(51) Int. Cl.
*F25B 9/00* (2006.01)
*F25B 9/10* (2006.01)
(Continued)

(52) U.S. Cl.
CPC ..... *F25B 9/145* (2013.01); *F25B 21/02* (2013.01); *F25B 2309/1418* (2013.01); *F25B 2309/1425* (2013.01)

(58) Field of Classification Search
CPC ..... F25B 2309/1409; F25B 2309/1418; F25B 2309/1481; F25B 2309/1424; F25B 2309/14241; F25B 9/00; F25B 9/10; F25B 9/14; F25B 9/145; F25B 41/04; F16K 1/06; F16K 27/0254; F16K 11/0836; F16K 31/0613; F16K 31/5286; F16K 31/50;
(Continued)

(56) References Cited

U.S. PATENT DOCUMENTS 3,409,270 A * 11/1968 Hulsey ..... F16K 5/10 251/209
4,064,908 A * 12/1977 Loe ..... F16K 1/38 137/614.17
(Continued)

FOREIGN PATENT DOCUMENTS

JP 2000-018744 A 1/2000
JP 2001-289523 A 10/2001
(Continued)

*Primary Examiner* — Frantz Jules
*Assistant Examiner* — Erik Mendoza-Wilkenfe
(74) *Attorney, Agent, or Firm* — HEA Law PLLC

(57) ABSTRACT

In a pulse tube refrigerator, a gas flow passage is connected to a high-temperature end of a low-temperature side pulse tube and a compressor, such that a working gas flows in the gas flow passage. The gas flow passage includes: a first flow passage connected to the high-temperature end of the low-temperature side pulse tube; a second flow passage connected to the compressor and having an outlet facing an outlet of the first flow passage; and a housing that gastightly accommodates the outlet of the first flow passage and the outlet of the second flow passage. The housing has a gastight space communicating with the outlet of the first flow passage and the outlet of the second flow passage, the gastight space located on a side of the low-temperature side pulse tube with respect to the outlet of the first flow passage.

5 Claims, 5 Drawing Sheets

(51) Int. Cl.

| | |
|---|---|
| ***F25B 9/14*** | (2006.01) |
| ***F25B 41/04*** | (2006.01) |
| ***F16K 1/06*** | (2006.01) |
| ***F16K 39/04*** | (2006.01) |
| ***F16K 1/12*** | (2006.01) |
| ***F25B 21/02*** | (2006.01) |

(58) Field of Classification Search
CPC ..... F16K 31/58; F16K 39/04; F16K 1/123; F16K 1/12
See application file for complete search history.

(56) References Cited

U.S. PATENT DOCUMENTS 4,311,170 A * 1/1982 Dolan ..... F16K 1/38 137/614.17
4,444,220 A * 4/1984 Seger ..... F16K 25/04 137/312
8,516,833 B2 8/2013 Xu et al.
2004/0089019 A1* 5/2004 Kawamura ..... F04F 5/04 62/500
2009/0151803 A1* 6/2009 Longsworth ..... F16K 31/041 137/630.21
2011/0000226 A1* 1/2011 Xu ..... F25B 9/14 62/6
2011/0000547 A1* 1/2011 Joseph ..... E21B 34/06 137/1

FOREIGN PATENT DOCUMENTS

JP 2003-329328 A 11/2003
JP 2003329328 A * 11/2003
JP 2005-114201 A 4/2005
JP 2005-265261 A 9/2005
JP 2008-232290 A 10/2008
JP 2011-012925 A 1/2011

* cited by examiner

PULSE TUBE REFRIGERATOR

RELATED APPLICATION

Priority is claimed to Japanese Patent Application No. 2014-184281, filed on Sep. 10, 2014, the entire content of which is incorporated herein by reference.

BACKGROUND OF THE INVENTION

1. Field of the Invention

The present invention relates to a pulse tube refrigerator, and more particularly, to a multi-stage pulse tube refrigerator.

2. Description of the Related Art

A pulse tube refrigerator is known as a refrigerator that generates cryogenic temperature. A pulse tube refrigerator generates cold at low-temperature ends of a regenerator tube and a pulse tube by repeating an operation of making a working gas (for example, helium gas), which is a working fluid compressed by a compressor, flow into the regenerator tube and the pulse tube and an operation of making the working fluid flow out of the pulse tube and the regenerator tube and recovering the working fluid to the compressor. Heat can be drawn from a cooling target by thermally contacting the cooling target at these low-temperature ends. In particular, a multi-stage multi-valve pulse tube refrigerator has characteristics of a high cooling efficiency and is expected to be applied to various fields.

SUMMARY OF THE INVENTION

A purpose of the present invention is to provide a technology for improving a refrigeration capacity of a pulse tube refrigerator.

According to an embodiment of the present invention, a pulse tube refrigerator includes: a compressor that generates a high-pressure working gas by compressing a low-pressure working gas; a high-temperature side regenerator that has a high-temperature end and a low-temperature end, the high-temperature end being connected to the compressor; a low-temperature side regenerator that has a high-temperature end and a low-temperature end, the high-temperature end being connected to the low-temperature end of the high-temperature side regenerator; a high-temperature side pulse tube that has a high-temperature end and a low-temperature end, the low-temperature end being connected to the low-temperature end of the high-temperature side regenerator, the high-temperature end being connected to the compressor; a low-temperature side pulse tube that has a high-temperature end and a low-temperature end, the low-temperature end being connected to the low-temperature end of the low-temperature side regenerator; and a gas flow passage that is connected to the high-temperature end of the low-temperature side pulse tube and the compressor, such that a working gas flows in the gas flow passage. The gas flow passage includes: a first flow passage that is connected to the high-temperature end of the low-temperature side pulse tube; a second flow passage that is connected to the compressor and has an outlet facing an outlet of the first flow passage; and a housing that gastightly accommodates the outlet of the first flow passage and the outlet of the second flow passage. The housing has a gastight space communicating with the outlet of the first flow passage and the outlet of the second flow passage, the gastight space located on a side of the low-temperature side pulse tube with respect to the outlet of the first flow passage.

BRIEF DESCRIPTION OF THE DRAWINGS

Embodiments will now be described, by way of example only, with reference to the accompanying drawings that are meant to be exemplary, not limiting, and wherein like elements are numbered alike in several figures, in which.

DETAILED DESCRIPTION OF THE INVENTION

The invention will now be described by reference to the preferred embodiments. This does not intend to limit the scope of the present invention, but to exemplify the invention.

An embodiment according to the present invention will be described with reference to the drawings. First, an entire configuration and an operation of a pulse tube refrigerator 200 according to an embodiment of the present invention will be described.

Figure 1:
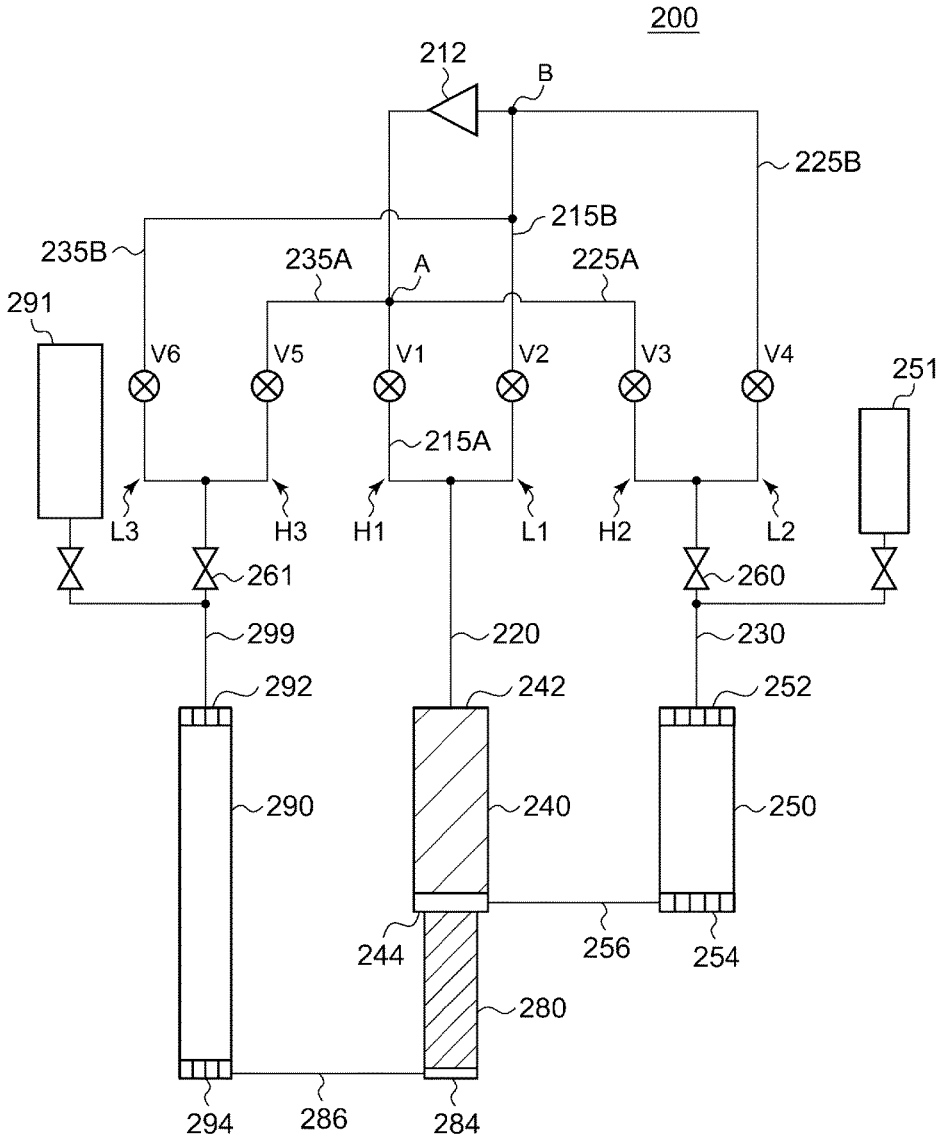
FIG. 1 is a diagram schematically illustrating an example of a 4-valve pulse tube refrigerator.

FIG. 1 is a diagram schematically illustrating the outline of the pulse tube refrigerator 200 according to the embodiment. The pulse tube refrigerator 200 has a two-stage structure.

As shown in FIG. 1, the pulse tube refrigerator 200 includes a compressor 212, a high-temperature side regenerator tube 240 and a low-temperature side regenerator tube 280, a high-temperature side pulse tube 250 and a low-temperature side pulse tube 290, a first pipe 256 and a second pipe 286, a first flow passage resistance 260 and a second flow passage resistance 261 provided with an orifice or the like, and on-off valves V1 to V6. The internal space of the high-temperature side regenerator tube 240 is filled with a high-temperature side regenerator material. The high-temperature side regenerator material is, for example, a copper wire mesh. The internal space of the low-temperature side regenerator tube 280 is filled with a low-temperature side regenerator material. The low-temperature side regenerator material is, for example, lead, bismuth, or tin particles.

The high-temperature side regenerator tube 240 includes a high-temperature end 242 and a low-temperature end 244. The low-temperature side regenerator tube 280 includes a high-temperature end 244 (corresponding to the low-temperature end 244 of the high-temperature side regenerator tube 240) and a low-temperature end 284. The high-temperature side pulse tube 250 includes a high-temperature end 252 and a low-temperature end 254. The low-temperature side pulse tube 290 includes a high-temperature end 292 and a low-temperature end 294. Heat exchangers are respectively provided in the high-temperature end 252 and the low-temperature end 254 of the high-temperature side pulse tube 250 and the high-temperature end 292 and the low-temperature end 294 of the low-temperature side pulse tube 290. Since the low-temperature end 244 of the high-temperature side regenerator tube 240 is common with the high-temperature end 244 of the low-temperature side regenerator tube 280, the high-temperature side regenerator tube 240 and the low-temperature side regenerator tube 280 are disposed such that longitudinal axes thereof are common with each other. Similarly, the high-temperature side regenerator tube 240 and the high-temperature side pulse tube 250 are disposed side by side such that longitudinal axes are parallel to each other. The low-temperature side regenerator tube 280 and the low-temperature side pulse tube 290 are disposed side by side such that longitudinal axes are parallel to each other.

The low-temperature end 244 of the high-temperature side regenerator tube 240 is connected to the low-temperature end 254 of the high-temperature side pulse tube 250 through the first pipe 256. The low-temperature end 284 of the low-temperature side regenerator tube 280 is connected to the low-temperature end 294 of the low-temperature side pulse tube 290 through the second pipe 286. Therefore, a temperature of a working gas at the low-temperature end 244 of the high-temperature side regenerator tube 240 is almost equal to a temperature of a working gas at the low-temperature end 254 of the high-temperature side pulse tube 250. Also, a temperature of a working gas at the low-temperature end 284 of the low-temperature side regenerator tube 280 is almost equal to a temperature of a working gas at the low-temperature end 294 of the low-temperature side pulse tube 290.

The low-temperature end 244 of the high-temperature regenerator tube 240 is common with the high-temperature end 244 of the low-temperature side regenerator tube 280. Therefore, the low-temperature end 284 of the low-temperature side regenerator tube 280 is lower in temperature than the low-temperature end 244 of the high-temperature side regenerator tube 240. Therefore, the low-temperature end 294 of the low-temperature side pulse tube 290 is lower in temperature than the low-temperature end 254 of the high-temperature side pulse tube 250.

A gas flow passage on a high-pressure side (discharge side) of the compressor 212 is branched in three direction at a point A in FIG. 1 such that a first gas supply passage H1, a second gas supply passage H2, and a third gas supply passage H3 are formed. The first gas supply passage H1 is formed from a first high-pressure pipe 215A, in which the first on-off valve V1 is installed, to a common pipe 220, and connects the high-pressure side of the compressor 212 and the high-temperature end 242 of the high-pressure side regenerator tube 240. The second gas supply passage H2 is formed from a second high-pressure pipe 225A, to which the third on-off valve V3 is connected, to a common pipe 230, in which the first flow passage resistance 260 is installed, and connects the high-pressure side of the compressor 212 and the high-temperature end 252 of the high-pressure side pulse tube 250. The third gas supply passage H3 is formed from a third high-pressure pipe 235A, to which the fifth on-off valve V5 is connected, and a common pipe 299, in which the second flow passage resistance 261 is installed, and connects the high-pressure side of the compressor 212 and the high-temperature end 292 of the high-pressure side pulse tube 290.

A gas flow passage on a low-pressure side (suction side) of the compressor 212 is branched in three direction into a first gas recovery passage L1, a second gas recovery passage L2, and a third gas recovery passage L3. The first gas recovery passage L1 is formed from the common pipe 220 to a point B through a first low-pressure pipe 215B in which the second on-off valve V2 is installed, and connects the high-temperature end 242 of the high-temperature side regenerator tube 240 and the compressor 212. The second gas recovery passage L2 is formed from the common pipe 230, in which the first flow passage resistance 260 is installed, to the point B through a second low-pressure pipe 225B, in which the fourth on-off valve V4 is installed, and connects the high-temperature end 252 of the high-temperature side pulse tube 250 and the compressor 212. The third gas recovery passage L3 is formed from the common pipe 299, in which the second flow passage resistance 261 is installed, to the point B through a third low-pressure pipe 235B, in which the sixth on-off valve V6 is installed, and connects the high-temperature end 292 of the low-temperature side pulse tube 290 and the compressor 212. As such, each of the common pipes 220, 230, and 299 becomes a portion of the gas supply passage when the compressor supplies the high-pressure gas, and becomes a portion of the gas recovery passage when the compressor supplies the low-pressure gas.

The compressor 212 recovers the low-pressure working gas from the gas flow passage of the low-pressure side. The compressor 212 generates the high-pressure working gas by compressing the recovered low-pressure working gas. The compressor 212 supplies the generated high-pressure working gas to the gas flow passage of the high-pressure side.

Next, the operation of the pulse tube refrigerator 200 will be described.

Figure 2:
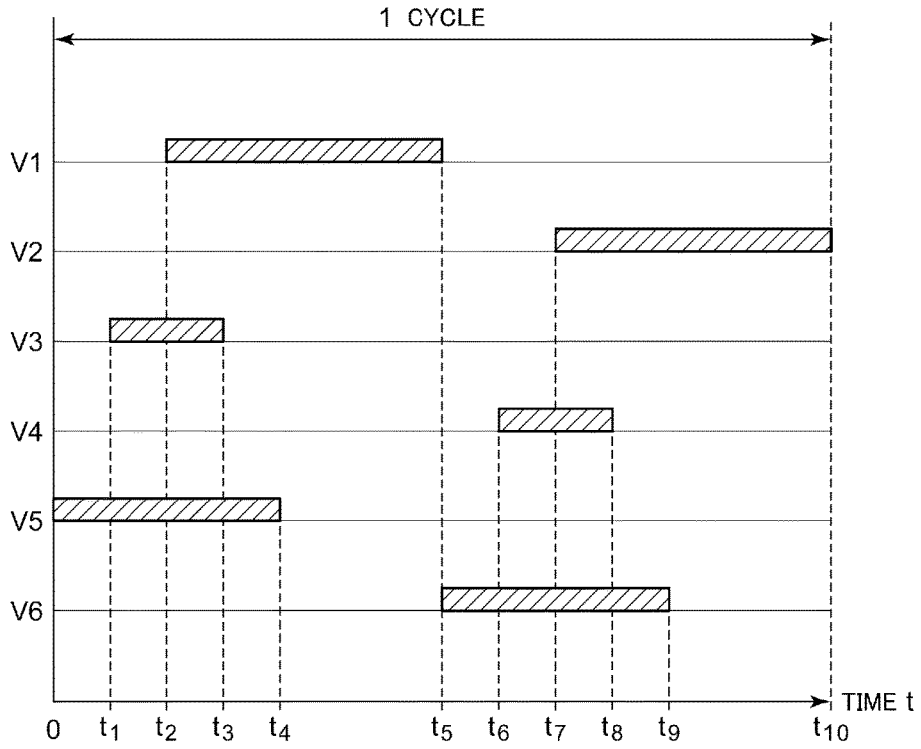
FIG. 2 is a diagram illustrating opened/closed states of six valves in time series during the operation of the 4-valve pulse tube refrigerator shown in FIG. 1.

FIG. 2 is a diagram illustrating opened/closed states of six valves in time series during the operation of the 4-valve pulse tube refrigerator 200 shown in FIG. 1 and is a diagram illustrating opened/closed states of the six on-off valves V1 to V6.

As shown in FIG. 2, during the operation of the pulse tube refrigerator 200, the opened/closed states of the six on-off valves V1 to V6 are periodically changed as follows.

First Process: Time 0 to t1

First, at time t=0, only the fifth on-off valve V5 is opened. Thereby, the high-pressure working gas is supplied from the compressor 212 through the third gas supply passage H3 to the low-temperature side pulse tube 290. That is, the high-pressure working gas is supplied to the low-temperature side pulse tube 290 via a passage from the third high-pressure pipe 235A to the high-pressure end 292 through the second flow passage resistance 261 and the common pipe 299. After that, at time t=t1, while the fifth on-off valve V5 is in the opened state, the third on-off valve V3 is opened. Thereby, the high-pressure working gas is supplied from the compressor 212 through the second gas supply passage H2 to the high-temperature side pulse tube 250. That is, the high-pressure working gas is supplied to the high-temperature side pulse tube 250 via a passage from the second high-pressure pipe 225A to the high-pressure end 252 through the common pipe 230.

Second Process: Time t2 to t3

Subsequently, at time t=t2, the first on-off valve V1 is opened while the on-off valves V5 and V3 are in an opened state. Thereby, the high-pressure working gas is supplied from the compressor 212 through the first gas supply passage H1 to the high-temperature side regenerator tube 240 and the low-temperature side regenerator tube 280. That is, the high-pressure working gas is supplied to the high-temperature side regenerator tube 240 and the low-temperature side regenerator tube 280 via a passage from the first high-pressure pipe 215A to the high-pressure end 242 through the common pipe 220. When passing through the high-temperature side regenerator tube 240 and the low-temperature side regenerator tube 280, the high-pressure working gas is cooled by the regenerator materials. A part of the working gas flows from the side of the low-temperature end 254 to the high-temperature side pulse tube 250 through the first pipe 256. Another part of the working gas passes through the low-temperature side regenerator tube 280 and flows from the side of the low-temperature end 294 to the low-temperature side pulse tube 290 through the second pipe 286.

Third Process: Time t3 to t4

Subsequently, at time t=t3, the third on-off valve V3 is closed while the first on-off valve V1 is in the opened state. After that, at time t=t4, the fifth on-off valve V5 is also closed. The working gas from the compressor 212 flows to the high-temperature side regenerator tube 240 through only the first gas supply passage H1. After that, the working gas flows from the sides of the low-temperature end 254 and the low-temperature end 294 into the high-temperature side pulse tube 250 and the low-temperature side pulse tube 290.

Fourth Process: Time t4 to t5

At time t=t5, all of the on-off valves V1 to V6 are closed. Due to a pressure increase in the high-temperature side pulse tube 250 and the low-temperature side pulse tube 290, a part of the working gas inside the high-temperature side pulse tube 250 and the low-temperature side pulse tube 290 is moved to a first reservoir 251 and a second reservoir 291 respectively installed in the high-temperature ends 252 and 292 of the two pulse tubes.

Fifth Process: Time t5 to t7

After that, at time t=t5, the sixth on-off valve V6 is opened and the working gas inside the low-temperature side pulse tube 290 returns to the compressor 212 through the third gas recovery passage L3. After that, at time t=t6, the fourth on-off valve V4 is opened and the working gas inside the high-temperature side pulse tube 250 returns to the compressor 212 through the second gas recovery passage L2. Thereby, the pressures of the high-temperature side pulse tube 250 and the low-temperature side pulse tube 290 decrease. That is, the working gas expands at the low-temperature end 254 of the high-temperature side pulse tube 250 and the low-temperature end 294 of the low-temperature side pulse tube 290, thereby generating cold.

Sixth Process: Time t7 to t8

Subsequently, at time t=t7, the second on-off valve V2 is opened while the on-off valves V6 and V4 are in an opened state. Due to this, most of the working gas inside the high-temperature side pulse tube 250, the low-temperature side pulse tube 290, and the low-temperature side regenerator tube 280 passes through the high-temperature side regenerator tube 240 and returns to the compressor 212 through the first gas recovery passage L1. When passing through the high-temperature side regenerator tube 240 and the low-temperature side regenerator tube 280, the expanded working gas cools the regenerator materials.

Seventh Process: Time t8 to t10

Then, at time t=t8, the fourth on-off valve V4 is closed while the second on-off valve V2 is in an opened state. After that, at time t=t9, the sixth on-off valve V6 is also closed. After that, at time t=t10, the second on-off valve V2 is closed and one cycle is completed.

By repeating the above-described cycle set as one cycle, cold can be generated at the low-temperature end 254 of the high-temperature side pulse tube 250 and the low-temperature end 294 of the low-temperature side pulse tube 290 and the cooling target can be cooled.

Here, the following description focuses on a loop-shaped passage (hereinafter, referred to as a "loop passage"), including the compressor 212, the high-temperature side regenerator tube 240, the low-temperature side regenerator tube 280, the low-temperature side pulse tube 290, and the second flow passage resistance 261. In each of the above-described processes, an amount of the working gas flowing out of the side of the high-temperature end 292 of the low-temperature side pulse tube 290 is larger than an amount of the working gas flowing out of the side of the low-temperature end 294 of the low-temperature side pulse tube 290. In this case, there exists a DC component of the working gas flowing in the loop passage from the low-temperature end 294 to the high-temperature end 292 of the low-temperature side regenerator tube 280. The DC component of the working gas in the loop passage may be referred to as a "DC flow" and it is known that the DC component of the working gas affects the refrigeration performance of the pulse tube refrigerator 200 significantly.

The second flow passage resistance 261 included in the loop passage is realized by, for example, an orifice, and functions to adjust the flow of the working gas in the loop passage. The inventors of the present application recognized the possibility that the second flow passage resistance 261 included in the loop passage can adjust the DC flow of the working gas in the loop passage. Hereinafter, the second flow passage resistance 261 according to the embodiment will be described in detail.

Figure 3:
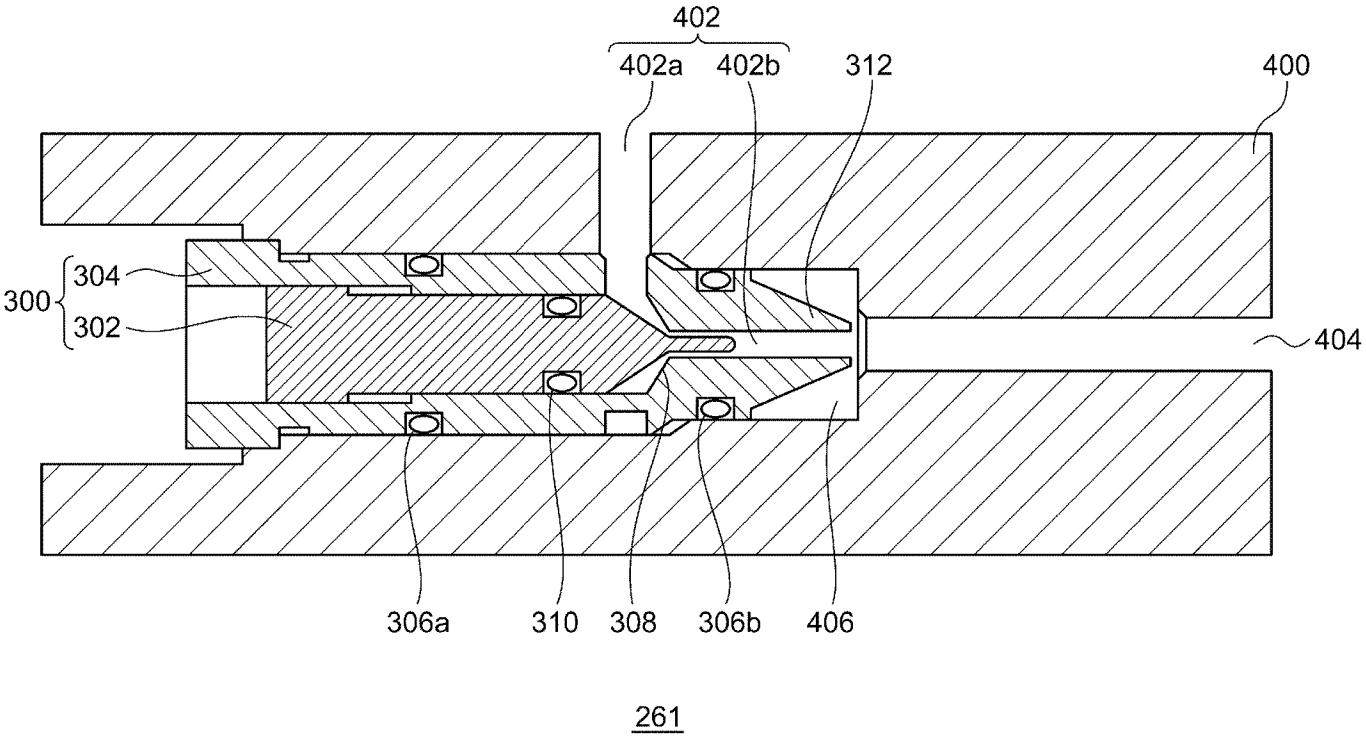
FIG. 3 is a diagram schematically illustrating a cross-section of a second flow passage resistance according an embodiment.

FIG. 3 is a diagram schematically illustrating a cross-section of the second flow passage resistance 261 according the embodiment. As shown in FIG. 3, the second flow passage resistance 261 according to the embodiment includes a needle valve 300 and a housing 400 accommodating the needle valve 300. The needle valve 300 includes a needle shaft 302 and a needle holder 304.

A housing-side first flow passage 402*a*, which is connected to the high-temperature end 292 of the low-temperature side pulse tube 290 through the common pipe 299, is provided in the housing 400. In addition, a second flow passage 404, which is connected to the third gas supply passage H3 and the third gas recovery passage L3, is provided in the housing 400. Both the third gas supply passage H3 and the third gas recovery passage L3 are connected to the compressor 212. Therefore, it is said that the second flow passage 404 is a flow passage connected to the compressor 212.

The needle holder 304 of the needle valve 300 is used by being inserted into the housing 400. When the needle holder 304 is inserted into the housing 400, a valve-side first flow passage 402*b* is provided to communicate with the housing-side first flow passage 402*a*. The housing-side first flow passage 402*a* and the valve-side first flow passage 402*b* are combined together to constitute the first flow passage 402. When the needle holder 304 is inserted into the housing 400, an outlet of the valve-side first flow passage 402*b* faces an outlet of the second flow passage 404. The outlet of the second flow passage 404 may be expanded such that a diameter thereof increases toward the first flow passage 402.

The needle holder 304 includes a first O-ring 306*a*. With the needle holder 304 inserted into the housing 400, the first O-ring 306*a* prevents external leakage through a gap between the needle holder 304 and the housing 400 when the working gas flows in the first flow passage 402 and the second flow passage 404. As a result, the outlet of the first flow passage 402 and the outlet of the second flow passage 404 are gastightly accommodated by the housing 400. In addition, the needle holder 304 includes a second O-ring 306*b*. Hence, the first O-ring 306*a* ensures the working gas to pass through the valve-side first flow passage 402*b*.

The needle shaft 302 of the needle valve 300 is used by being screwed to the needle holder 304 that is inserted in the housing 400. When the needle shaft 302 is screwed to the needle holder 304, a tip portion of the needle shaft 302 is inserted into the valve-side first flow passage 402*b*. When the needle shaft 302 rotates, the needle shaft 302 moves along a screw of the needle holder 304. An orifice 308 is formed in a portion of the valve-side first flow passage 402*b* into which the tip portion of the needle shaft 302 is inserted. Therefore, by moving the needle shaft 302 within the needle holder 304, it is possible to adjust a flow rate (flow passage resistance) of the working gas flowing in the first flow passage 402. The needle shaft 302 includes a third O-ring 310. Hence, the third O-ring 310 prevents external leakage through the gap between the needle holder 304 and the housing 400 when the working gas flows in the first flow passage 402 and the second flow passage 404.

As described above, the valve-side first flow passage 402*b* is a flow passage provided within the needle holder 304, and the needle holder 304 is a tube that forms the valve-side first flow passage 402*b*. Therefore, the needle holder 304 functions as a wall portion of the valve-side first flow passage 402*b*. As shown in FIG. 3, an end portion of the needle holder 304 on the side of the second flow passage 404 has a tapered region 312 in which a wall thickness becomes smaller toward the side of the second flow passage 404. The body portion of the needle holder 304 has a cylindrical shape, but the end portion on the side of the second flow passage 404 having the tapered region 312 has a tapered truncated cone shape.

A region of the housing 400, into which the needle holder 304 is inserted, is substantially a cylindrical hole. Therefore, when the needle holder 304 is inserted into the housing 400, a gastight space 406 is formed by the tapered region 312 of the needle holder 304 and the housing 400. As shown in FIG. 3, there is a gap between the outlet of the valve-side first flow passage 402*b* and the outlet of the second flow passage 404 facing the outlet of the first flow passage. Therefore, the gastight space 406 is a space communicating with both the outlet of the valve-side first flow passage 402*b* and the outlet of the second flow passage 404 through the gap.

The gastight space 406 is a space formed by the tapered region 312 of the needle holder 304 and the housing 400. Therefore, the gastight space 406 exists on the side of the needle shaft 302, that is, the side of the low-temperature side pulse tube 290, with respect to the position of the outlet of the valve-side first flow passage 402*b*. Since a part of an inner wall of the gastight space 406 is an outer wall of the tapered region 312, the gastight space 406 has a shape that becomes gradually narrower from the side of the second flow passage 404 to the valve-side first flow passage 402*b*. Hereinafter, the valve-side first flow passage 402*b*, the second flow passage 404, and the gastight space 406 will be described in detail.

Figure 4A:
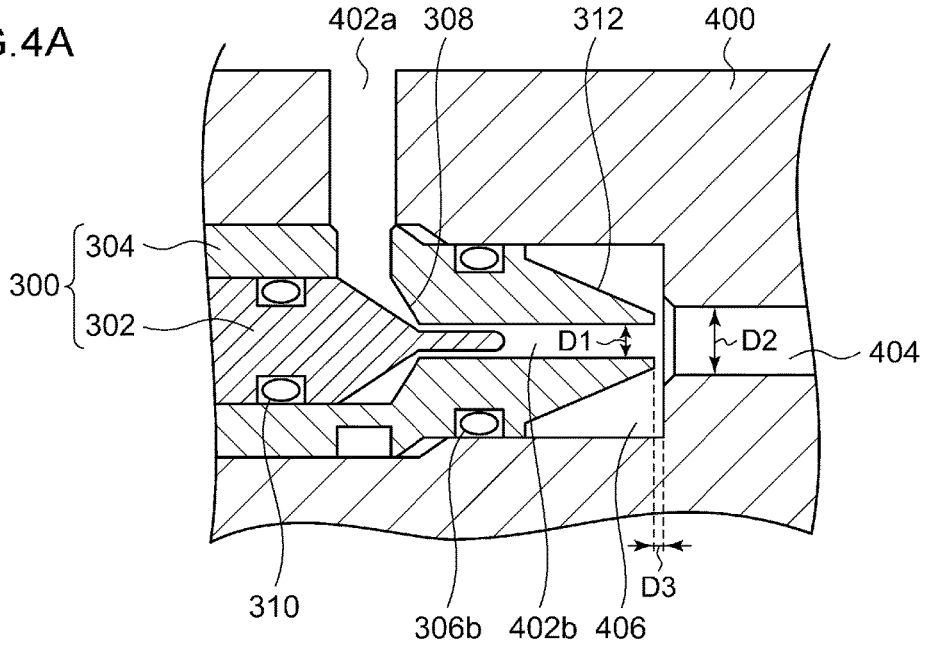
FIGS. 4A and 4B are enlarged views schematically illustrating a tapered region of a needle holder.
Figure 4B:
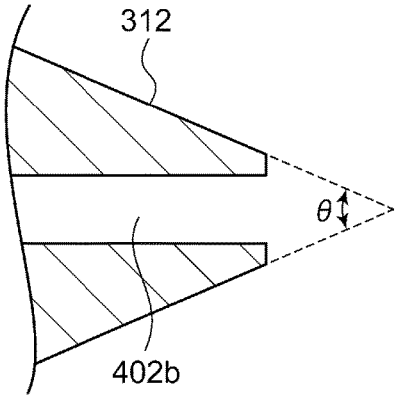

FIGS. 4A and 4B are enlarged views schematically illustrating the tapered region 312 of the needle holder 304.

FIG. 4A is a diagram schematically illustrating a magnitude relationship of a flow passage diameter D1 of the outlet of the valve-side first flow passage 402*b*, a flow passage diameter D2 of the outlet of the second flow passage 404 facing the valve-side first flow passage 402*b*, and a distance D3 between the two outlets. As shown in FIG. 4A, the flow passage diameter D1 of the outlet of the valve-side first flow passage 402*b* is smaller than the flow passage diameter D2 of the outlet of the second flow passage 404. Further, the distance D3 between the outlet of the valve-side first flow passage 402*b* on the side of the second flow passage 404 and the outlet of the second flow passage 404 on the side of the valve-side first flow passage 402*b* is smaller than the flow passage diameter D1 of the valve-side first flow passage 402*b*. As a non-limiting example, the flow passage diameter D1 of the outlet of the valve-side first flow passage 402*b* is 1 [mm], and the flow passage diameter D2 of the outlet of the second flow passage 404 is 3 [mm]. The distance D3 between the outlet of the valve-side first flow passage 402*b* on the side of the second flow passage 404 and the outlet of the second flow passage 404 on the side of the valve-side first flow passage 402*b* is 0.5 [mm]. The valve-side first flow passage 402 and the second flow passage 404 are coaxially arranged.

In the fifth process as described above, the working gas inside the low-temperature side pulse tube 290 is recovered to the compressor 212 through the third gas recovery passage L3. At this time, the working gas reaches the outlet of the second flow passage 404 through the housing-side first flow passage 402*a* and the valve-side first flow passage 402*b*. On the other hand, in the first process and the second process as described above, the working gas discharged from the compressor 212 flows into the low-temperature side pulse tube 290 through the third gas supply passage H3. At this time, the working gas reaches the outlet of the valve-type first flow passage 402*b* through the second flow passage 404. For convenience of the following description, in the second flow passage resistance 261, a direction from the low-temperature side pulse tube 290 to the compressor 212 may be referred to as a "recovery direction," and a direction from the compressor 212 to the low-temperature side pulse tube 290 may be referred to as a "supply direction."

When the working gas flows in the recovery direction, since the flow passage diameter D1 of the outlet of the valve-side first flow passage 402*b* is smaller than the flow passage diameter D2 of the outlet of the second flow passage 404, the working gas flowing out of the valve-side first flow passage 402*b* flows into the second flow passage 404 as it is. However, when the working gas flows in the supply direction, a part of the working gas flowing out of the second flow passage 404 flows into the gastight space 406. In particular, when the working gas flowing in the vicinity of the wall portion of the second flow passage 404 exits from the outlet of the second flow passage, the working gas easily flows into the gastight space 406.

Therefore, in an area in which the outlet of the valve-side first flow passage 402*b* and the outlet of the second flow passage 404 face each other, the working gas toward the recovery direction more easily flows than the working gas toward the supply direction. That is, in an area in which the outlet of the valve-side first flow passage 402*b* and the outlet of the second flow passage 404 face each other, the flow passage resistance toward the recovery direction is smaller than the flow passage resistance toward the supply direction. Thereby, it is possible to generate a DC flow of the working gas in the above-described loop passage.

The flow passage diameter D1 of the outlet of the valve-side first flow passage 402*b*, the flow passage diameter D2 of the outlet of the second flow passage 404, and the distance D3 between the outlet of the valve-side first flow passage 402*b* on the side of the second flow passage 404 and the outlet of the second flow passage 404 on the side of the valve-side first flow passage 402*b* are parameters for adjusting the DC flow. For example, by making the flow passage diameter D1 of the outlet of the valve-side first flow passage 402*b* be further smaller than the flow passage diameter D2 of the outlet of the second flow passage 404, it is possible to increase a difference between the flow passage resistance toward the recovery direction and the flow passage resistance toward the supply direction.

If the distance D3 between the outlet of the valve-side first flow passage 402*b* on the side of the second flow passage 404 and the outlet of the second flow passage 404 on the side of the valve-side first flow passage 402*b* is excessively increased, a part of the working gas toward the recovery direction may also flow into the gastight space 406. Hence, it is preferable that the distance D3 between the outlets is equal to or less than the flow passage diameter D1 of the outlet of the valve-side first flow passage 402*b*.

As described above, the gastight space 406 exists on side of the low-temperature side pulse tube 290 with respect to the outlet of the valve-side first flow passage 402*b*. Therefore, even when the distance D3 between the outlets is zero, if the flow passage diameter D1 of the outlet of the valve-side first flow passage 402*b* is smaller than the flow passage diameter D2 of the outlet of the second flow passage 404, a part of the working gas flowing in the supply direction flows into the gastight space 406, thereby making it possible to generate the DC flow. Furthermore, if the distance D3 between the outlets exists even slightly, a part of the working gas flowing in the supply direction flows into the gastight space 406 even when the flow passage diameter D1 of the outlet of the valve-side first flow passage 402*b* is equal to the flow passage diameter D2 of the outlet of the second flow passage 404. In consideration of the above, it is preferable that D1, D2, and D3 satisfy the following inequality (1).

$$D3 \leq D1 \leq D2 \quad (1)$$

Here, the parameters for adjusting the DC flow include a taper angle θ of the tapered region 312 as well as D1, D2, and D3 described above.

FIG. 4B is an enlarged view illustrating the tapered region 312 of the needle holder 304 according to the embodiment, and more specifically, a cross-sectional view of the needle holder 304 taken along a plane including a major axis thereof. As illustrated in FIG. 4B, the tapered region 312 of the needle holder 304 is a linear taper, and an angle of an external wall portion of the tapered region 312 with respect to the major axis of the needle holder 304 is constant. Therefore, in the cross-sectional view shown in FIG. 4B, the angle θ formed by the outer wall portion of the tapered region 312 is the taper angle of the tapered region 312. If the taper angle θ is less than 180 degrees, the gastight space 406 can be formed and the DC flow can be generated. As the taper angle θ is smaller, a volume of the gastight space 406 becomes larger.

The inventors of the present application conducted a test to evaluate the refrigeration performance of the pulse tube refrigerator 200 by changing the taper angle θ of the tapered region 312. As a result, it was found that if the taper angle θ is between 180 degrees and 45 degrees, the refrigeration performance of the pulse tube refrigerator 200 was more improved as the taper angle θ is smaller. It was found that if the taper angle θ is less than 45 degrees, a correlation between the taper angle θ and the refrigeration performance of the pulse tube refrigerator 200 was reduced.

As the taper angle θ of the tapered region 312 of the needle holder 304 is smaller, a tube wall of the valve-side first flow passage 402*b* becomes thinner. Therefore, the excessively small taper angle θ is not preferable from the viewpoint of securing the strength of the needle holder 304. From the above, the taper angle θ of the tapered region 312 of the needle holder 304 may be less than 180 degrees. In particular, it is preferable that the taper angle θ is 90 degrees or less. In summary, it is preferable that the taper angle θ satisfies the following inequality (2).

$$45 \text{ degrees} \leq \theta < 180 \text{ degrees} \quad (2)$$

As described above, the pulse tube refrigerator 200 according to the embodiment generates the DC flow by improving the second flow passage resistance 261 in the loop passage including the compressor 212, the high-temperature side regenerator tube 240, the low-temperature side regenerator tube 280, and the low-temperature side pulse tube 290. Thereby, it is possible to improve the refrigeration performance of the pulse tube refrigerator 200.

While the present invention has been described based on the embodiment, the embodiment is merely illustrative of the principles and applications of the present invention. Additionally, many variations and changes in arrangement may be made in the embodiment without departing from the spirit of the present invention as defined by the appended claims.

Modifications

In the above description, the gastight space 406 is formed by providing the tapered region 312 at the end portion of the needle holder 304 on the side of the second flow passage 404. However, the method of forming the gastight space 406 is not limited to the above.

Figure 5A:
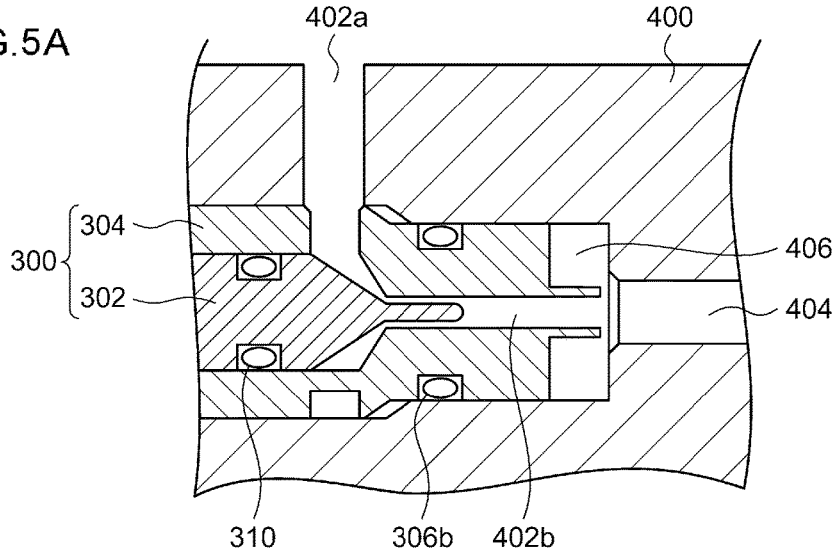
FIGS. 5A and 5B are diagrams schematically illustrating a gastight space according to a modification of the embodiment.
Figure 5B:
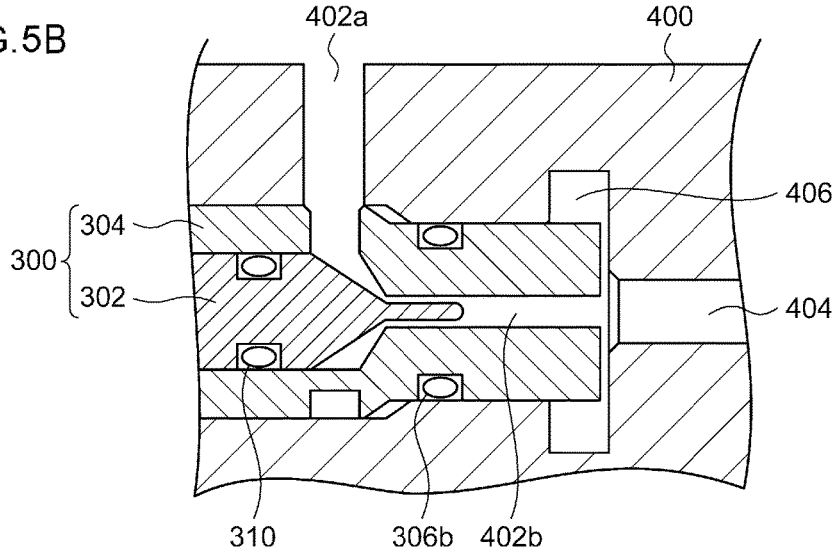

FIGS. 5A and 5B are diagrams schematically illustrating a gastight space 406 according to a modification of the embodiment. Specifically, FIG. 5A is a schematic diagram of a gastight space 406 according to a first modification, and FIG. 5B is a schematic diagram of a gastight space 406 according to a second modification.

In the first modification shown in FIG. 5A, a diameter of an end portion of a needle holder 304 on the side of a second flow passage 404 is smaller than a diameter of a body portion of the second flow passage 404. However, a shape of a housing 400 is similar to a shape of the housing 400 according to the embodiment, and a region into which the needle holder 304 is inserted is a cylindrical hole. Therefore, when the needle holder 304 according to the first modification is inserted into the housing 400, a gastight space 406 is formed by a small-diameter portion of the needle holder 304 and the housing 400.

In the second modification shown in FIG. 5B, a diameter of an end portion of a needle holder 304 on the side of the second flow passage 404 is equal to a diameter of a body portion of the second flow passage 404. Instead, as shown in FIG. 5B, a groove is provided in a portion of the housing 400 in which an end portion of the needle holder 304 on the side of a second flow passage 404 is accommodated. The groove functions as a gastight space 406.

In both of the gastight space 406 according to the first modification shown in FIG. 5A and the gastight space 406 according to the second modification shown in FIG. 5B, the gastight space 406 exists on the side of a low-temperature side pulse tube 290 with respect to an outlet of a valve-side first flow passage 402*b*. In addition, a flow passage diameter D1 of the outlet of the valve-side first flow passage 402*b*, a flow passage diameter D2 of an outlet of a second flow passage 404, and a distance D3 between the outlet of the valve-side first flow passage 402*b* on the side of the second flow passage 404 and the outlet of the second flow passage 404 on the side of the valve-side first flow passage 402*b* are adjusted to satisfy the above-described inequality (1).

By providing the gastight space 406 according to the first modification or the gastight space 406 according to the second modification, a flow passage resistance toward a recovery direction is smaller than a flow passage resistance toward a supply direction in an area in which the outlet of the valve-side first flow passage 402*b* and the outlet of the second flow passage 404 face each other. Thereby, it is possible to generate a DC flow of a working gas in the above-described loop passage. As a result, it is possible to improve the refrigeration performance of the pulse tube refrigerator 200.

In the above description, the two-stage pulse tube refrigerator 200 has been described as an example. However, the number of stages of the pulse tube refrigerator is not limited to two stages and may be three or more stages.

It should be understood that the invention is not limited to the above-described embodiment, but may be modified into various forms on the basis of the spirit of the invention. Additionally, the modifications are included in the scope of the invention.

What is claimed is:

1. A pulse tube refrigerator comprising:

a compressor that generates a high-pressure working gas by compressing a low-pressure working gas;

a high-temperature side regenerator that has a high-temperature end and a low-temperature end, the high-temperature end being connected to the compressor;

a low-temperature side regenerator that has a high-temperature end and a low-temperature end, the high-temperature end being connected to the low-temperature end of the high-temperature side regenerator;

a high-temperature side pulse tube that has a high-temperature end and a low-temperature end, the low-temperature end being connected to the low-temperature end of the high-temperature side regenerator, the high-temperature end being connected to the compressor;

a low-temperature side pulse tube that has a high-temperature end and a low-temperature end, the low-temperature end being connected to the low-temperature end of the low-temperature side regenerator; and a gas flow passage that is connected to the high-temperature end of the low-temperature side pulse tube and the compressor, such that a working gas flows in the gas flow passage, wherein the gas flow passage includes:

a tube having a tube end portion;

a first flow passage having a first outlet connected to the high-temperature end of the low-temperature side pulse tube and a second outlet formed through the tube end portion, the second outlet on an opposite end of the first flow passage from the first outlet;

a second flow passage connected to the compressor, the second flow passage having an outlet on an opposite end of the second flow passage from the compressor; and a housing that gastightly accommodates the tube end portion, the second outlet of the first flow passage and the outlet of the second flow passage, wherein the housing and the tube end portion together form a gastight space filled with the working gas, wherein the second flow passage is formed as a through-hole through the housing and arranged coaxially with the second outlet of the first flow passage, the outlet of the second flow passage arranged axially spaced apart from the second outlet of the first flow passage to form a gap between the second outlet of the first flow passage and the outlet of the second flow passage, the gastight space communicating with the second outlet of the first flow passage and the outlet of the second flow passage through the gap, and wherein the gas flow passage is configured to prevent gas leakage between the gastight space and the first outlet of the first flow passage, and configured to ensure the working gas passes through the second outlet of the first flow passage between the outlet of the second flow passage and the first outlet of the first flow passage.

2. The pulse tube refrigerator according to claim 1, wherein a flow passage diameter of the second outlet of the first flow passage is equal to or smaller than a flow passage diameter of the outlet of the second flow passage.

3. The pulse tube refrigerator according to claim 1, wherein the gastight space becomes gradually narrower from a side of the second flow passage toward a side of the first flow passage.

4. The pulse tube refrigerator according to claim 1, wherein the tube end portion is tapered toward the outlet of the second flow passage, the tapered end portion having a wall thickness tapering toward the second flow passage, at a taper angle of less than 180 degrees.

5. The pulse tube refrigerator according to claim 1, wherein a distance between the second outlet of the first flow passage on a side of the second flow passage and the outlet of the second flow passage on a side of the first flow passage is shorter than a flow passage diameter of the first flow passage.

* * * * *